US008186183B2

(12) United States Patent
Esser

(10) Patent No.: US 8,186,183 B2
(45) Date of Patent: May 29, 2012

(54) WASHER EXTRACTOR DOOR LOCK

(75) Inventor: Scott M. Esser, Ripon, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 387 days.

(21) Appl. No.: 12/470,143

(22) Filed: May 21, 2009

(65) Prior Publication Data

US 2009/0288346 A1 Nov. 26, 2009

Related U.S. Application Data

(60) Provisional application No. 61/055,707, filed on May 23, 2008.

(51) Int. Cl.
*D06F 39/00* (2006.01)

(52) U.S. Cl. ..... 68/12.26; 68/3 R; 49/373

(58) Field of Classification Search ..... None
See application file for complete search history.

(56) References Cited

U.S. PATENT DOCUMENTS

| | | | | |
|---|---|---|---|---|
| 1,981,534 | A * | 11/1934 | Dawe et al. | 335/131 |
| 3,912,891 | A | 10/1975 | Mercer et al. | |
| 4,852,520 | A | 8/1989 | Goetz | |
| 4,982,468 | A * | 1/1991 | Takahashi et al. | 8/159 |
| 5,823,473 | A | 10/1998 | Odell et al. | |
| 5,921,643 | A | 7/1999 | Louth | |
| 6,031,301 | A * | 2/2000 | Callahan et al. | 307/119 |
| 7,275,398 | B2 | 10/2007 | Kim et al. | |

* cited by examiner

*Primary Examiner* — Michael Kornakov
*Assistant Examiner* — Eric Golightly
(74) *Attorney, Agent, or Firm* — Leydig, Voit & Mayer, Ltd.

(57) ABSTRACT

A latching and locking mechanism for a door includes a locating pin passing through a portion of a door frame and a handle. A tapered portion formed at an end of the locating pin mates with a tapered opening formed in a casing of the machine to position the door frame relative to the casing. A cam surface defined on the casing engages a latching pin connected to the locating pin and extending radially therefrom adjacent to the tapered portion such that the latching pin pulls the door frame toward the closed position when the handle is rotated.

20 Claims, 4 Drawing Sheets

WASHER EXTRACTOR DOOR LOCK

CROSS-REFERENCE TO RELATED APPLICATIONS

This patent application claims the benefit of U.S. Provisional Patent Application No. 61/055,707, filed May 23, 2008, which is incorporated herein in its entirety by reference.

BACKGROUND

Door locks and latches used for commercial and residential equipment and appliances are often subjected to repeated use. Such use can cause wear and breakdowns in the mechanisms of the locks and latches, especially in commercial settings. For example, laundry machines used for commercial applications, such as hotels and hospitals, might operate continuously and might be indispensible parts of the owner or operator's business insofar as minimizing downtime for repairs or maintenance is highly beneficial.

Common modes of malfunction for latching and locking mechanisms used on doors of commercial appliances may include loose fitting of doors, inadequate sealing around the doors, grinding and/or difficult operation of latching and/or locking mechanisms for the doors, and so forth. Such issues, often cause leaks or inefficient operation of the machines, inadequate locking of the latches used on the doors, which may lead to vandalism of theft of the machine's contents, insufficient functionality of safety features, such as false readings of door condition or door-lock sensors, and so forth.

SUMMARY OF THE DISCLOSURE

In one aspect, the disclosure describes a latching and locking mechanism for a door of a machine. The mechanism includes a locating pin passing through a portion of a door frame, and a handle connected at the end of the locating pin. A tapered portion is formed at an other end of the locating pin. The tapered portion mates with a tapered opening formed in a casing of the machine to position the door frame relative to the casing. A cam surface defined on the casing engages a latching pin connected to the locating pin and extending radially therefrom adjacent to the tapered portion. Engagement between the latching pin and the inward slope of the tapered portion operates to pull the door frame toward the closed position when the handle is rotated.

In another aspect, the disclosure describes a latching and locking mechanism for a door that includes a locating pin rotatably disposed through a portion of the door frame. A handle is arranged to rotate the locating pin, which has a tapered end defining a conical surface that mates with a locating surface formed in a block connected to the frame of the machine to locate the door. The block also forms a cam surface that tapers away from the door and a centering surface that is adjacent a lock opening formed in the block. When locking the door, a latching pin, which is connected to the locating pin and that has a roller, rotates with the handle such that the roller traverses the cam surface reaching the centering surface. A locking pin extends through the lock opening and into a bore formed in the locking pin to prevent rotation of the latching pin.

DETAILED DESCRIPTION

This disclosure is applicable to latching and locking mechanisms used to secure doors on residential and/or commercial appliances. The disclosure below describes one embodiment of a latching and locking mechanism relative to a laundry machine having a front-loading configuration, but the embodiment described herein can be used on other types of machines or machines having different configurations than what is described in the present disclosure.

Figure 1:
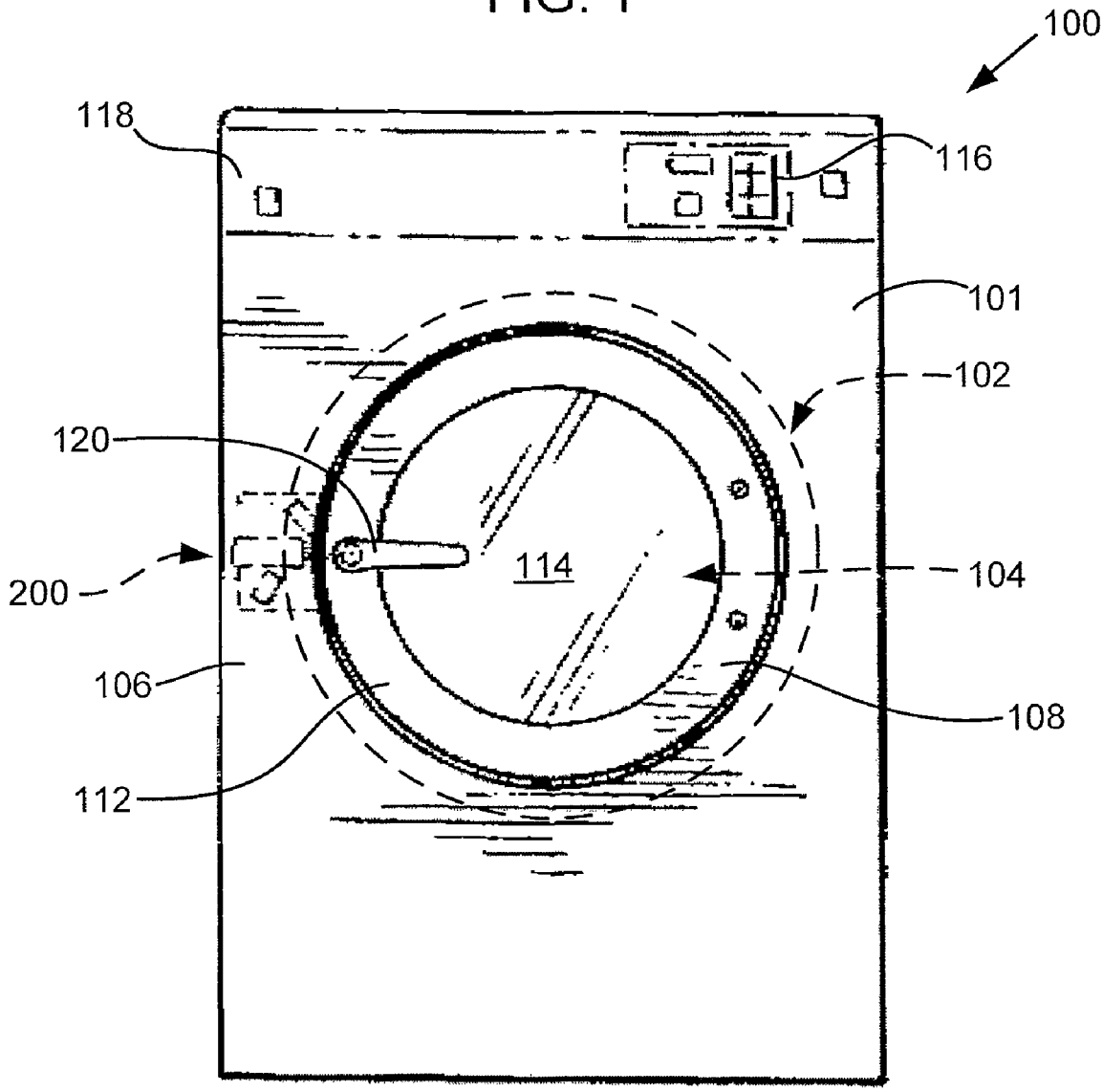
FIG. 1 is an outline view of a machine in accordance with the disclosure.

An outline view of a machine 100 is shown in FIG. 1. In the embodiment illustrated, the machine 100 is a washer-extractor 101 for commercial applications, but the locking and latching mechanism disclosed herein is equally useable in other machine configurations and types. In this embodiment, the machine 100 includes a tumbler or bucket 102 located within the machine 100 and accessible for loading and unloading of laundry through an opening 104 formed in a casing 106 of the machine 100. The opening 104 is closed and sealed by a door 108, which is hingeably connected to the casing 106 at one side of the opening 104, and has a latch assembly 200 releasably engaging the casing 106 at an opposite side of the opening 104. The door 108 includes a frame portion 112 that surrounds a window 114, which allows a user to view the contents of the bucket 102 during operation. Various functions of the machine 100 can be controlled by selectively activating switches 116 installed on a control panel 118 of the casing 106.

The door 108 is closed during operation of the machine 100 and, while closed, sealably engages the casing 106. The latch assembly 200 is useful in locking the door 108 when the machine 100 is operating, as well as maintaining a closing force on the door 108 to create a water-tight seal between the door 108 and the casing 106. An operator may engage the latch assembly 200 by turning a handle 120 operating the door locking mechanism.

In one embodiment, the user can unlock and unlatch the door 108 by turning the handle 120 about ninety degrees. A locked, generally horizontal position of the handle is shown in FIG. 1. The handle 120 may be rotated to an unlocked, generally vertical position after operating the machine 100 by turning the handle about 90 degrees in a clock wise direction. When unlatched, the door 108 is free to open and provide access to the bucket 102 for loading and unloading of the machine 100. When the user wishes to close the door 108, the user may swing the door 108 in a closing direction until the door 108 contacts the casing 106. When the door 108 first makes contact with the casing 106, the user may rotate the handle 120 about ninety degrees in a counter-clockwise direction, thus accomplishing two functions. First, a latching mechanism (shown in the figures that follow) may pull the door 108 against the casing 106, for example, by about 0.280 inches (about 0.7112 centimeter), such that a proper seal is made around the opening 104 while also centering the door 108 within the opening 104. Second, a locking mechanism (also shown in the figures that follow) may lock the door 108 in the closed position and, in conjunction with an electronic controller and appropriate sensors, may also sense a locking condition of the door 108 relative to the opening 104 such that operation of the machine 100 may be interrupted if the door 108 is unlocked or unlatches unexpectedly during certain operations of the machine.

Figure 2:
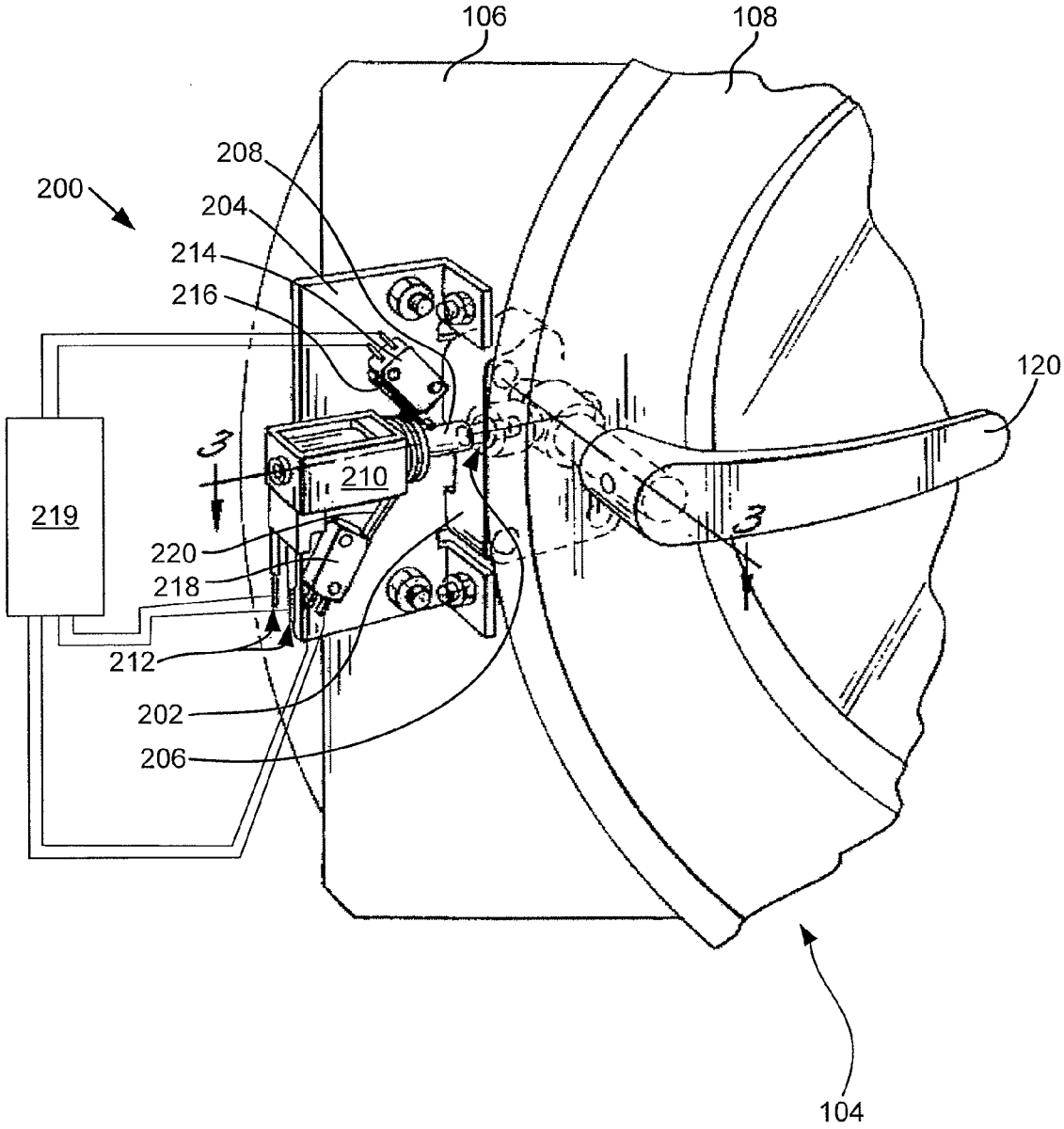
FIG. 2 is a partial cut-away view of a latching and locking mechanism for a door in accordance with the disclosure.

The latching and locking mechanism of the machine 100 will now be described in further detail. A partial cutaway of the machine 100 in the area around the locking and latching mechanism or assembly of the door 108 is shown in FIG. 2. In the description that follows, same or similar elements are denoted by like reference numerals throughout the figures for the sake of simplicity. In the illustrated view, a portion of the door 108 engaging a portion of the casing 106 of the machine 100 near a latching and locking mechanism 200 is presented. The handle 120 is shown in the closed or locked position. The latching and locking mechanism 200 includes elements that can center the door 108 relative to the opening 104, latch the door 108 onto the casing 106 of the machine 100, as well as lock the handle 120 in the latched position during operation of the machine 100. Other features are also discussed, for example, diagnostic elements that can control operation of the machine 100 depending on the locked or unlocked state of the door 108. In general, the latching and locking mechanism 200 performs two functions, namely, latching of the door 108 to the casing 106 of the machine, and locking of the latched door 108 during operation of the machine 100. The elements of the mechanism 200 performing such functions will now be described.

As stated above, one function of the mechanism 200 is for latching the door 108 in the closed position. In the illustrated embodiment, a roller is used that rides onto an inwardly sloped cam surface when the handle 120 is turned. An additional function of the mechanism 200 is locking the door 108 when in the latched position. When locking the door 108, a pin may be moved to engage components of the latching mechanism 200 preventing rotation of the handle 120 and associated components, thus preventing the unlocking of the door 108.

More specifically, the latching and locking mechanism 200 includes a latching cam block 202 that is connected to a casing 204 of the machine 100. The latching cam block 202 forms a lock opening 206, through which a locking pin 208 may enter and lock the door 108 when the door is in its latched position. In one embodiment, the locking and unlocking of the door 108 is accomplished by use of electronic actuators responsive to commands from an electronic controller to automatically lock and unlock the door 108. In the illustrated embodiment, the locking pin 208 is connected to and operated by a solenoid actuator 210 having electrical terminals 212 that are operatively connected to a power source (not shown) whose operation is controlled by an electronic controller 219 or any other suitable arrangement.

The mechanism 200 further includes sensors providing signals to the electronic controller 219 indicative of the locked state of the mechanism 200 and the door 108. In the illustrated embodiment, a first toggle sensor 214 has a tongue 216 that is actuated when the locking pin 208 is extended into a locked position. Similarly, a second toggle sensor 218 has a tongue 220 that is actuated by a lever (not visible) that touches a component of the latching arrangement when the door 108 is fully latched. Both the first toggle sensor 214 and the second toggle sensor 218 may be operatively connected to the electronic controller 219 such that sensor readings of presence of the locked or unlocked condition of the door 108 may be used by the electronic controller to control various functions and/or safety features of the machine 100. In the illustrated embodiment, the first and second toggle sensors 214 and 218 operate by closing respective electrical connections when activated, which in turn provide the appropriate indications of the state of each sensor to the electronic controller.

Figures 3, 3A:
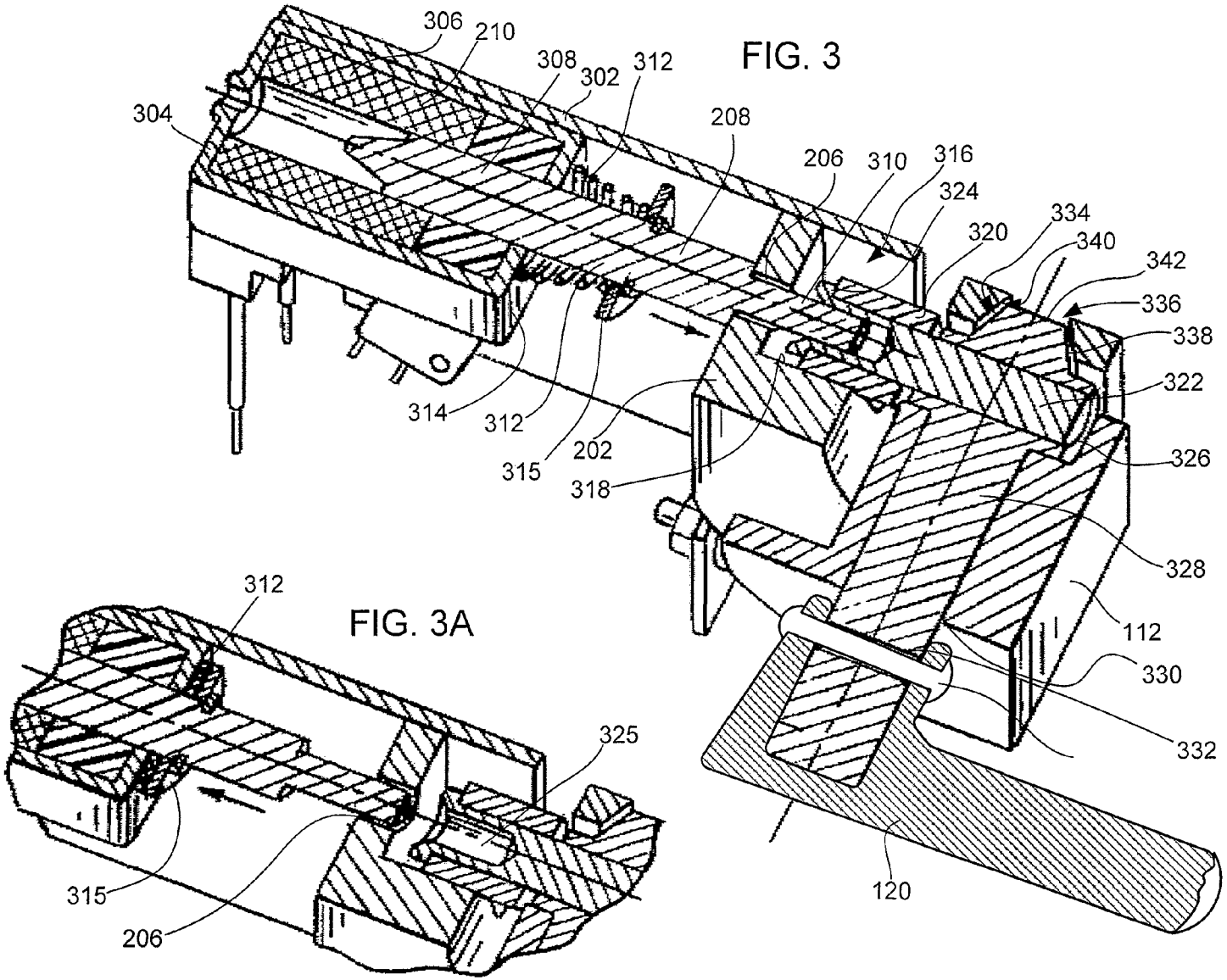
FIG. 3 is a cross section of the latching and locking mechanism shown in FIG. 2.

A cross section of the latching and locking mechanism 200 in a locked condition is shown in FIG. 3, and a detail cross section showing the mechanism 200 in an unlocked condition is shown in FIG. 3A. Locking and unlocking of the mechanism is accomplished by motion of a locking pin 208 into and out from an opening or locking bore 325 formed in a component of the mechanism 200. In the illustrated embodiment, motion of the locking pin 208 is accomplished by a solenoid actuator 210. The solenoid actuator 210 operates the locking pin 208 and is mounted on the machine 100 by a bracket 302 having a rectangular portion 304 surrounding the solenoid actuator 210. A winding or coil 306 of the solenoid actuator 210 imparts an electromagnetic force that moves a core portion 308 relative to the casing 204. The core portion 308 is connected to the locking pin 208 at an end thereof. The locking pin 208 has a lock portion 310 that passes through the lock opening 206 formed in the latching cam block 202 and providing access to the locking bore 325. A resilient element or spring 312 is disposed between a face 314 of the rectangular portion 304 of the bracket 302 and a plate 315 disposed around a portion of the locking pin 208. In the embodiment shown, the spring 312 is compressed when the solenoid actuator 210 is energized to retract the locking pin 208, and extended when the solenoid actuator 210 is energized in an opposite direction to extend the locking pin 208 into its locking position.

When latching the door 108, rotational motion of the handle 120 causes a roller 320 to engage a cam surface 318 and pull the door 108 toward a closed position. More specifically, the latching cam block 202 defines a latching cam channel 316 having a cam surface 318 formed on one side thereof. The cam surface 318, which is described in further detail below, engages the rolling element or roller 320, which is rotatably disposed around a latching pin 322 connected to the handle 120. In the illustrated embodiment, the latching pin 322 forms a channel 324 adjacent to one end thereof that rotatably accepts the roller 320. The latching pin 322 further forms the locking bore 325, which has a tapered opening that accepts the locking pin 208. The locking bore 325 is arranged to engage or accept at least a linear segment of the lock portion 310 when the locking pin 208 is extended through the lock opening 206 of the latching cam block 202 and locks the handle 120 into place, as best shown in FIG. 3.

In the illustrated embodiment, the latching pin 322 is disposed within an opening 326 formed in a locating pin 328. The locating pin 328 is a shaft having a generally tubular shape that is connected at one end to the handle 120 and that rotates relative to the frame 112 of the door 108 when the handle 120 is rotated. In the illustrated embodiment, a fastener opening 332 has a fastener 333 passing therethrough to securely attach the handle 120 to the end of the locating pin 328. Adjacent the other end thereof, the locating pin forms the opening 326 accepting the latching pin 322 with an interference fit.

The mechanism 200 is further disposed to align the door 108 with the opening 104 (FIG. 1) in the casing 106 of the machine 100. To accomplish such alignment, the mechanism 200 includes a locating pin engaging a tapered or conical opening, which positions the door relative to the casing. The locating pin 328 operates to align the door 108 with the casing 106 when the door 108 is moved to the closed position. The locating pin 328 forms a tapered surface or tapered nose 334 at an opposite or inner end 336 thereof. The tapered nose 334 includes a conical surface 338 that positions the locating pin 328, and thus the door 108, at a desired or predetermined position relative to the machine 100 when the door 108 is closed by engaging a mating conical surface 340 that surrounds a locator opening 342 formed in a portion of the latching cam block 202.

Figure 4:
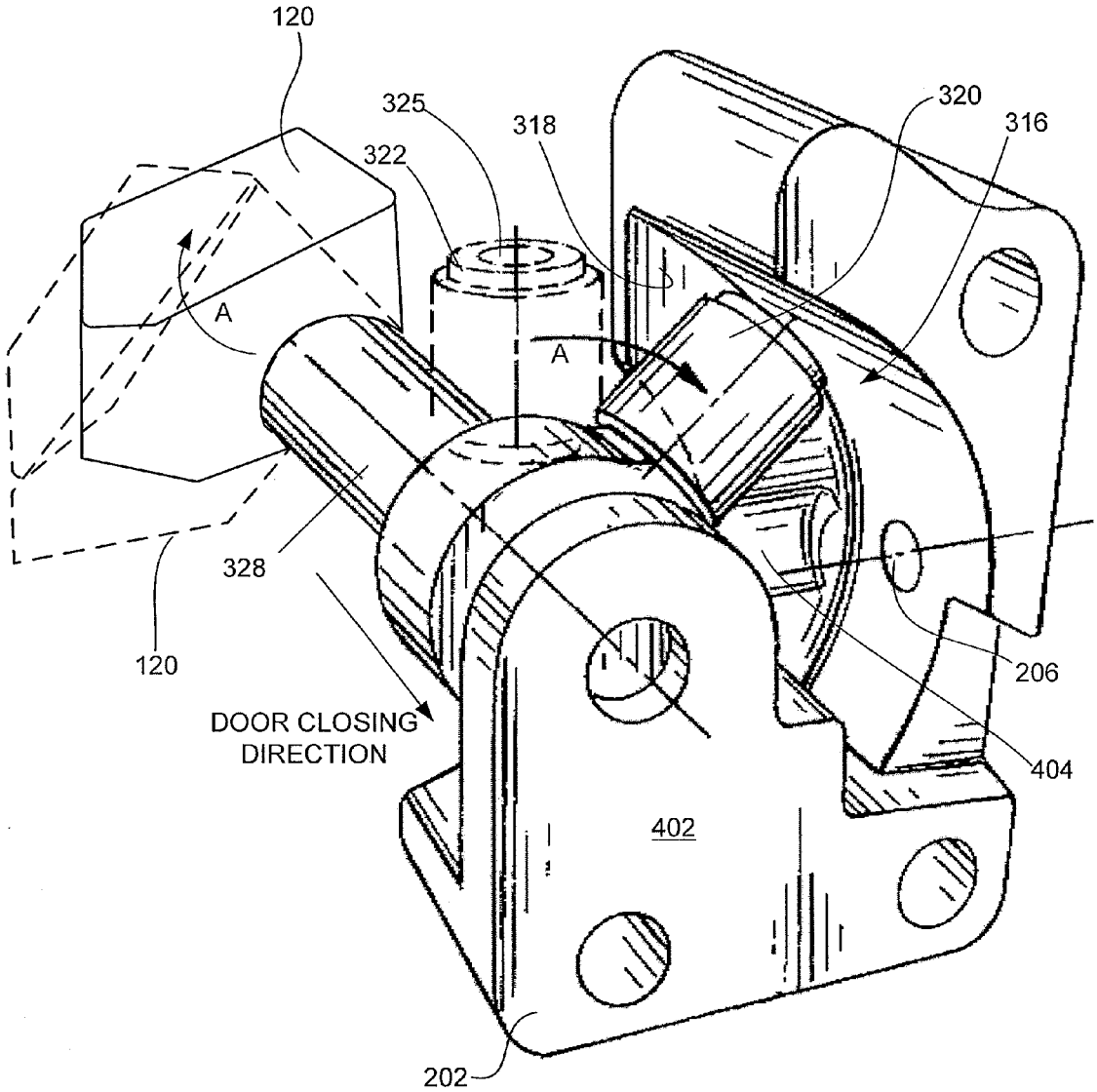
FIG. 4 is an outline view of a latching cam block in accordance with the disclosure.

Outline views of the latching cam block 202 and of the locating pin 328 having the latching pin 322 and roller 320 connected thereto are shown in FIG. 4, which illustrates the relative motion of the various components during the latching process. The latching cam block 202 of FIG. 4 is shown from the inside perspective relative to the machine 100 but removed from the machine 100 for clarity. From this perspective, a mounting surface 402 used to connect the block 202 to the frame of the machine is shown in the forefront of FIG. 4, and one side of the latching cam channel 316 is open revealing the cam surface 318. An unlocked position of the handle 120 and latching pin 322 are shown in dashed line, and an intermediate position of the same components during a latching motion is shown in solid line.

As can be seen from the illustration, the cam surface 318 engages and guides the roller 320 as the handle 120 is rotated in the "A" direction. The cam surface 318 is a generally flat surface that extends along a circular segment that follows the path of rotation of the roller 320 when the handle 120 is turned. The cam surface 318 is tapered toward the mounting surface 402, i.e. inwardly relative to the machine 100, such that the door 108 is pulled in the door closing direction toward the machine as the handle 120 turns.

When the handle 120 has been sufficiently rotated, and the roller 320 has traversed the cam surface 318, the cam surface 318 forms a cradle or centering surface 404 that positions the roller 320 in proper position and alignment for locking, as shown and described relative to FIG. 3 and FIG. 3A. From the perspective of FIG. 4, it can be seen that contact of the roller 320 transitions from the cam surface 318 to the centering surface 404 as the handle is rotated 90 degrees. The centering surface 404 is defined on the latching cam block 202 adjacent to the cam surface 318 and along the path of the roller 320. The centering surface 404, as shown, is generally cylindrical in shape but may, alternatively, have any other shape, for example, triangular or tapered, that can cradle or accept the roller 320 therewithin when the handle 120 has been sufficiently rotated to its fully latched position.

The centering surface ensures that the locking bore 325 of the locating pin 328 is sufficiently aligned with the lock opening 206 in the latching cam block 202 and with the lock portion 310 of the locking pin 208 that passes therethrough (FIG. 3). Moreover, the roller 320 may also engage a lever (not shown) that actuates the tongue 220 of the second toggle sensor 218 (FIG. 2) when the roller 320 is seated within the centering surface 404 to indicate a fully latched condition. It is noted that compression of an elastically compressible seal between the door 108 and the casing 106 of the machine 100 helps the roller 320 maintain its seated position within the centering surface 404.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A latching and locking mechanism for a door hingeably connected at one end thereof to a casing of a machine and disposed to close an opening formed in the machine, comprising:

a locating pin for locating the door relative to the casing, said locating pin being rotatably disposed through a portion of a frame of the door;

a handle connected at an end of said locating pin and arranged to rotate the locating pin relative to said frame between a latched position and an unlatched position;

a tapered portion formed at an end of said locating pin opposite said handle;

a tapered opening formed in said casing of the machine, the tapered opening engaging said tapered portion of said locating pin to position said frame relative to said casing;

a cam surface defined on the casing of the machine;

a latching pin connected to said locating pin and extending radially therefrom, said latching pin being arranged to engage said cam surface and pull said door toward a closed position when said handle is rotated from said unlatched position toward said latched position; and a concave cradling surface defined at an end of said cam surface for receiving a portion of said latching pin therewithin to provide a stop to a rotation range of said latching pin and said handle and to locate said latching pin relative to said casing when said door is in said latched position.

2. The latching and locking mechanism of claim 1, further comprising a roller disposed in a channel formed adjacent a free end of said latching pin, said roller arranged for a rolling engagement between said latching pin and said cam surface.

3. The latching and locking mechanism of claim 2, wherein said concave cradling surface accepts said roller therewithin for locating said roller relative to said casing when said door is in said latched position.

4. The latching and locking mechanism of claim 1, further comprising:

a locking pin slidably connected with the casing and extending generally perpendicularly relative to an axis of rotation of said locating pin when said door is in said latched position; and a locking bore formed in said latching pin along a centerline thereof and being open at a free end of said latching pin;

wherein said locking pin extends into said locking bore when said locking pin is in an extended position while said latching pin is rotated to said latched position.

5. The latching and locking mechanism of claim 4, further including a solenoid actuator connected to said casing and arranged to energize a core reciprocally disposed therewithin, wherein said locking pin is connected at a free end of said core such that said locking pin is extended into said extended position when said solenoid actuator is energized.

6. The latching and locking mechanism of claim 5, further comprising a first toggle switch arranged to close a first electrical connection when said locking pin is in said extended position, and a second toggle switch arranged to close a second electrical connection when said locking pin is in a retracted position.

7. The latching and locking mechanism of claim 6, further comprising an electronic controller integrated with the machine and disposed to provide a signal energizing said solenoid actuator based on a state of said first electrical connection and said second electrical connection.

8. The latching and locking mechanism of claim 1, wherein said tapered opening and said cam surface are formed on a mounting block connected to said casing of the machine.

9. The latching and locking mechanism of claim 8, wherein said cam surface is flat and has a semicircular shape, and wherein said cam surface is inwardly sloped such that said latching pin is pulled toward said machine when said handle is rotated toward said latched position.

10. The latching and locking mechanism of claim 1, wherein the machine is a front loading commercial washer having a circular opening providing access to a bucket disposed within said casing, wherein said door is arranged to block and sealably engage said casing around said circular opening, wherein said frame is hingeably connected on one side thereof to said casing, and wherein said handle is disposed at a diametrically opposite side of said frame relative to said one side thereof.

11. The latching and locking mechanism of claim 1, wherein said tapered portion of said locating pin has a generally conical shape, and wherein said tapered opening has a generally conical shape that mates with said tapered portion when said door is in said latched position.

12. A machine having a casing that houses a bucket and forms an opening for providing access to the bucket, and a door hingeably connected to said casing and disposed to sealably block said opening when said door is in a closed position, the machine comprising:

a locating pin for locating the door relative to the casing, the locating pin being rotatably disposed through a portion of a frame of the door;

a handle connected at an end of said locating pin and arranged to rotate the locating pin relative to said frame between a latched position and an unlatched position;

a tapered portion formed at an end of said locating pin opposite said handle;

a tapered opening formed in said casing of the machine, the tapered opening engaging said tapered portion of said locating pin to position said frame relative to said casing;

a cam surface defined on the casing of the machine;

a latching pin connected to said locating pin and extending radially therefrom, said latching pin being arranged to engage said cam surface and pull said door toward a closed position when said handle is rotated from said unlatched position toward said latched position; and a concave cradling surface defined at an end of said cam surface for receiving a portion of said latching pin therewithin to provide a stop to a rotation range of said latching pin and said handle and to locate said latching pin relative to said casing when said door is in said latched position.

13. The machine of claim 12, further comprising a roller disposed in a channel formed adjacent a free end of said latching pin, said roller arranged for a rolling engagement between said latching pin and said cam surface.

14. The machine of claim 13, wherein said concave cradling surface accepts said roller therewithin for locating said roller relative to said casing when said door is in said closed position.

15. The machine of claim 12, further comprising:

a locking pin slidably connected with the casing and extending generally perpendicularly relative to an axis of rotation of said locating pin when said door is in the closed position; and a locking bore formed in said latching pin along a centerline thereof and being open at a free end of said latching pin;

wherein said locking pin extends into said locking bore when said locking pin is in an extended position while said latching pin is rotated to the latched position.

16. The machine of claim 15, further including a solenoid actuator connected to said casing and arranged to energize a core reciprocally disposed therewithin, wherein said locking pin is connected at a free end of said core such that said locking pin is extended into said extended position when said solenoid actuator is energized.

17. The machine of claim 16, further comprising a first toggle switch arranged to close a first electrical connection when said locking pin is in said extended position, and a second toggle switch arranged to close a second electrical connection when said locking pin is in a retracted position.

18. The machine of claim 17, further comprising an electronic controller integrated with the machine and disposed to provide a signal energizing said solenoid actuator based on a state of said first electrical connection and said second electrical connection.

19. The machine of claim 12, wherein said cam surface is flat and has a semicircular shape, and wherein said cam surface is inwardly sloped such that said latching pin is pulled toward said machine when said handle is rotated toward the latched position.

20. The machine of claim 12, wherein said tapered portion of said locating pin has a generally conical shape, and wherein said tapered opening has a generally conical shape that mates with said tapered portion when said door is in the closed position.

* * * * *